US008792619B2

(12) United States Patent
Miller

(10) Patent No.: US 8,792,619 B2
(45) Date of Patent: Jul. 29, 2014

(54) X-RAY TUBE WITH SEMICONDUCTOR COATING

(75) Inventor: Eric J. Miller, Provo, UT (US)

(73) Assignee: Moxtek, Inc., Orem, UT (US)

( * ) Notice: Subject to any disclaimer, the term of this patent is extended or adjusted under 35 U.S.C. 154(b) by 350 days.

(21) Appl. No.: 13/429,111

(22) Filed: Mar. 23, 2012

(65) Prior Publication Data

US 2013/0077758 A1 Mar. 28, 2013

Related U.S. Application Data

(60) Provisional application No. 61/469,234, filed on Mar. 30, 2011.

(51) Int. Cl.

| | |
|---|---|
| ***H01J 35/02*** | (2006.01) |
| ***H01J 35/14*** | (2006.01) |
| ***H01J 35/16*** | (2006.01) |

(52) U.S. Cl.

CPC ..... *H01J 35/16* (2013.01); *H01J 2235/186* (2013.01); *H01J 2235/081* (2013.01); *H01J 35/14* (2013.01)

USPC ..... 378/139; 378/121

(58) Field of Classification Search

CPC ..... H01J 35/16; H01J 35/22; H05G 1/32

USPC ..... 378/119–144

See application file for complete search history.

(56) References Cited

U.S. PATENT DOCUMENTS

| | | | |
|---|---|---|---|
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,683,223 | A | 7/1954 | Hosemann |
| 2,952,790 | A | 9/1960 | Steen |
| 3,218,559 | A | 11/1965 | Applebaum |
| 3,356,559 | A | 12/1967 | Mohn et al. |
| 3,434,062 | A | 3/1969 | Cox |
| 3,679,927 | A | 7/1972 | Kirkendall |
| 3,801,847 | A | 4/1974 | Dietz |
| 3,828,190 | A | 8/1974 | Dahlin et al. |
| 3,851,266 | A | 11/1974 | Conway |
| 3,872,287 | A | 3/1975 | Kooman |
| 3,882,339 | A | 5/1975 | Rate et al. |
| 3,894,219 | A | 7/1975 | Weigel |
| 4,007,375 | A | 2/1977 | Albert |

(Continued)

FOREIGN PATENT DOCUMENTS

| | | |
|---|---|---|
| DE | 10 30 936 | 5/1958 |
| DE | 44 30 623 | 3/1996 |

(Continued)

OTHER PUBLICATIONS http://www.orau.org/ptp/collectio/xraytubescollidge/MachlettCW250T.htm, 1999, 2 pages.

(Continued)

*Primary Examiner* — Courtney Thomas

(74) *Attorney, Agent, or Firm* — Thorpe North & Western LLP

(57) ABSTRACT

An x-ray tube with a semiconductor coating disposed over an exterior the tube. The semiconductor material reduces voltage gradients.

20 Claims, 8 Drawing Sheets

(56) References Cited

U.S. PATENT DOCUMENTS 4,075,526 A 2/1978 Grubis
4,160,311 A 7/1979 Ronde et al.
4,184,097 A 1/1980 Auge
4,393,127 A 7/1983 Greschner et al.
4,400,822 A 8/1983 Kuhnke et al.
4,421,986 A 12/1983 Friauf et al.
4,463,338 A 7/1984 Utner et al.
4,504,895 A 3/1985 Steigerwald
4,521,902 A 6/1985 Peugeot
4,679,219 A 7/1987 Ozaki
4,688,241 A 8/1987 Peugeot
4,734,924 A 3/1988 Yahata et al.
4,761,804 A 8/1988 Yahata
4,777,642 A 10/1988 Ono
4,797,907 A 1/1989 Anderton
4,819,260 A 4/1989 Haberrecker
4,870,671 A 9/1989 Hershyn
4,891,831 A 1/1990 Tanaka et al.
4,969,173 A 11/1990 Valkonet
4,979,198 A 12/1990 Malcolm et al.
4,995,069 A 2/1991 Tanaka
5,010,562 A 4/1991 Hernandez et al.
5,063,324 A 11/1991 Grunwald
5,066,300 A 11/1991 Isaacson et al.
5,077,771 A 12/1991 Skillicorn et al.
5,077,777 A 12/1991 Daly
5,090,046 A 2/1992 Friel
5,105,456 A 4/1992 Rand et al.
5,117,829 A 6/1992 Miller et al.
5,153,900 A 10/1992 Nomikos et al.
5,161,179 A 11/1992 Suzuki et al.
5,178,140 A 1/1993 Ibrahim
5,187,737 A 2/1993 Watanabe
5,200,984 A 4/1993 Laeuffer
5,226,067 A 7/1993 Allred et al.
RE34,421 E 10/1993 Parker et al.
5,267,294 A 11/1993 Kuroda et al.
5,343,112 A 8/1994 Wegmann
5,347,571 A 9/1994 Furbee et al.
5,391,958 A 2/1995 Kelly
5,400,385 A 3/1995 Blake et al.
5,422,926 A 6/1995 Smith
5,428,658 A 6/1995 Oettinger et al.
5,469,429 A 11/1995 Yamazaki et al.
5,469,490 A 11/1995 Golden et al.
5,478,266 A 12/1995 Kelly
RE35,383 E 11/1996 Miller et al.
5,621,780 A 4/1997 Smith et al.
5,627,871 A 5/1997 Wang
5,631,943 A 5/1997 Miles
5,680,433 A 10/1997 Jensen
5,682,412 A 10/1997 Skillicorn et al.
5,696,808 A 12/1997 Lenz
5,729,583 A 3/1998 Tang et al.
5,812,632 A 9/1998 Schardt et al.
5,907,595 A 5/1999 Sommerer
5,978,446 A 11/1999 Resnick
6,005,918 A 12/1999 Harris et al.
6,044,130 A 3/2000 Inazura et al.
6,069,278 A 5/2000 Chuang
6,073,484 A 6/2000 Miller et al.
6,075,839 A 6/2000 Treseder
6,097,790 A 8/2000 Hasegawa et al.
6,129,901 A 10/2000 Moskovits et al.
6,133,401 A 10/2000 Jensen
6,134,300 A 10/2000 Trebes et al.
6,184,333 B1 2/2001 Gray
6,205,200 B1 3/2001 Boyer et al.
6,277,318 B1 8/2001 Bower
6,282,263 B1 8/2001 Arndt et al.
6,288,209 B1 9/2001 Jensen
6,307,008 B1 10/2001 Lee et al.
6,320,019 B1 11/2001 Lee et al.
6,351,520 B1 2/2002 Inazaru
6,385,294 B2 5/2002 Suzuki et al.
6,388,359 B1 5/2002 Duelli et al.
6,438,207 B1 8/2002 Chidester et al.
6,477,235 B2 11/2002 Chornenky et al.
6,487,272 B1 11/2002 Kutsuzawa
6,487,273 B1 11/2002 Takenaka et al.
6,494,618 B1 12/2002 Moulton
6,546,077 B2 4/2003 Chornenky et al.
6,567,500 B2 5/2003 Rother
6,658,085 B2 12/2003 Sklebitz et al.
6,661,876 B2 12/2003 Turner et al.
6,740,874 B2 5/2004 Doring
6,778,633 B1 8/2004 Loxley et al.
6,799,075 B1 9/2004 Chornenky et al.
6,803,570 B1 10/2004 Bryson, III et al.
6,816,573 B2 11/2004 Hirano et al.
6,819,741 B2 11/2004 Chidester
6,852,365 B2 2/2005 Smart et al.
6,866,801 B1 3/2005 Mau et al.
6,876,724 B2 4/2005 Zhou
6,956,706 B2 10/2005 Brandon
6,976,953 B1 12/2005 Pelc
6,987,835 B2 1/2006 Lovoi
7,035,379 B2 4/2006 Turner et al.
7,046,767 B2 5/2006 Okada et al.
7,049,735 B2 5/2006 Ohkubo et al.
7,050,539 B2 5/2006 Loef et al.
7,075,699 B2 7/2006 Oldham et al.
7,085,354 B2 8/2006 Kanagami
7,108,841 B2 9/2006 Smalley
7,110,498 B2 9/2006 Yamada
7,130,380 B2 10/2006 Lovoi et al.
7,130,381 B2 10/2006 Lovoi et al.
7,203,283 B1 4/2007 Puusaari
7,206,381 B2 4/2007 Shimono et al.
7,215,741 B2 5/2007 Ukita
7,224,769 B2 5/2007 Turner
7,233,647 B2 6/2007 Turner et al.
7,286,642 B2 10/2007 Ishikawa et al.
7,305,066 B2 12/2007 Ukita
7,317,784 B2 1/2008 Durst et al.
7,358,593 B2 4/2008 Smith et al.
7,382,862 B2 6/2008 Bard et al.
7,428,298 B2 9/2008 Bard et al.
7,448,801 B2 11/2008 Oettinger et al.
7,486,774 B2 2/2009 Cain
7,526,068 B2 4/2009 Dinsmore
7,529,345 B2 5/2009 Bard et al.
7,634,052 B2 12/2009 Grodzins et al.
7,649,980 B2 1/2010 Aoki et al.
7,650,050 B2 1/2010 Haffner et al.
7,657,002 B2 2/2010 Burke et al.
7,675,444 B1 3/2010 Smith et al.
7,680,652 B2 3/2010 Giesbrecht et al.
7,693,265 B2 4/2010 Hauttmann et al.
7,709,820 B2 5/2010 Decker et al.
7,737,424 B2 6/2010 Xu et al.
7,756,251 B2 7/2010 Davis et al.
2002/0090053 A1* 7/2002 Chornenky et al. ..... 378/119
2003/0096104 A1 5/2003 Tobita et al.
2003/0152700 A1 8/2003 Asmussen et al.
2003/0165418 A1 9/2003 Ajayan et al.
2004/0076260 A1 4/2004 Charles, Jr. et al.
2005/0018817 A1 1/2005 Oettinger et al.
2005/0141669 A1 6/2005 Shimono et al.
2005/0207537 A1 9/2005 Ukita
2006/0073682 A1 4/2006 Furukawa et al.
2006/0098778 A1 5/2006 Oettinger et al.
2006/0210020 A1 9/2006 Takahashi et al.
2006/0233307 A1 10/2006 Dinsmore
2006/0269048 A1 11/2006 Cain
2006/0280289 A1 12/2006 Hanington et al.
2007/0025516 A1 2/2007 Bard et al.
2007/0111617 A1 5/2007 Meilahti
2007/0172104 A1 7/2007 Nishide
2007/0183576 A1 8/2007 Burke et al.
2007/0217574 A1 9/2007 Beyerlein
2008/0296479 A1 12/2008 Anderson et al.
2008/0296518 A1 12/2008 Xu et al.
2008/0317982 A1 12/2008 Hecht

(56) References Cited

U.S. PATENT DOCUMENTS

| | | | |
|---|---|---|---|
| 2009/0085426 | A1 | 4/2009 | Davis et al. |
| 2009/0086923 | A1 | 4/2009 | Davis et al. |
| 2009/0213914 | A1 | 8/2009 | Dong et al. |
| 2009/0243028 | A1 | 10/2009 | Dong et al. |
| 2010/0098216 | A1 | 4/2010 | Dobson |
| 2010/0126660 | A1 | 5/2010 | O'Hara |
| 2010/0189225 | A1 | 7/2010 | Ernest et al. |
| 2010/0243895 | A1 | 9/2010 | Xu |
| 2010/0285271 | A1 | 11/2010 | Davis et al. |

FOREIGN PATENT DOCUMENTS

| | | |
|---|---|---|
| DE | 19818057 | 11/1999 |
| EP | 0 297 808 | 1/1989 |
| EP | 0330456 | 8/1989 |
| GB | 1252290 | 11/1971 |
| JP | 57 082954 | 8/1982 |
| JP | 3170673 | 7/1991 |
| JP | 4171700 | 6/1992 |
| JP | 5066300 | 3/1993 |
| JP | 5135722 | 6/1993 |
| JP | 06 119893 | 7/1994 |
| JP | 6289145 | 10/1994 |
| JP | 08315783 | 11/1996 |
| JP | 2003/007237 | 1/2003 |
| JP | 2003211396 | 7/2003 |
| JP | 2006297549 | 11/2008 |
| KR | 1020050107094 | 11/2005 |
| WO | WO2008/052002 | 5/2008 |

OTHER PUBLICATIONS

Micro X-ray Tube Operation Manual, X-ray and Specialty Instruments Inc., 1996, 5 pages.

US Appl. No. 12/899,750, filed Oct. 7, 2010; Steven Liddiard.

US Appl. No. 13/018,667, filed Feb. 1, 2011; Robert C. Davis.

US Appl. No. 13/307,579, filed Nov. 30, 2011; Dongbing Wang.

PCT Application No. PCT/US2011/044168; filed Mar. 28, 2012; Kang Hyun Il; report mailed Mar. 28, 2012.

U.S. Appl. No. 12/890,325; Sep. 24, 2010; Dongbing Wang; office action dated Sep. 7, 2012.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

U.S. Appl. No. 12/899,750, filed Oct. 7, 2010; Steven Liddiard; notice of allowance dated Jun. 4, 2013.

U.S. Appl. No. 12/890,325, filed Sep. 24, 2010; Dongbing Wang; notice of allowance dated Jul. 16, 2013.

PCT/US2011/044168; Filed Jul. 15, 2011; Dongbing Wang; international search report dated Mar. 28, 2012.

* cited by examiner

X-RAY TUBE WITH SEMICONDUCTOR COATING

CLAIM OF PRIORITY

Priority is claimed to U.S. Provisional Patent Application Ser. No. 61/469,234, filed on Mar. 30, 2011; which is hereby incorporated herein by reference in its entirety.

BACKGROUND

X-ray sources can be operated with very large voltage differentials, such as for example from 10 kilovolts to 80 kilovolts (kV). Problems associated with the high voltages in x-ray sources include (1) a breakdown of insulative potting material, which surrounds an x-ray tube and electrically isolates it from other x-ray source components, and (2) instability caused by surface charges along an x-ray tube cylinder.

Illustrated in FIG. 8 is a longitudinal cross-sectional side view of an x-ray source 800 comprising an evacuated enclosure 101, a cathode 102 attached to the evacuated enclosure 101 and configured to emit electrons 104 within the enclosure, and an anode 103 attached to the evacuated enclosure 101, configured to receive electrons 104 emitted from the cathode, and configured to emit x-rays 108 in response to impinging electrons 104.

The cathode 102 can be configured to emit electrons by an electron emitter 111, such as a filament. The filament can be heated, such as by alternating current from an alternating current source 105. A large bias voltage differential may be created between the cathode 102 and electron emitter 111 and the anode 103 by a high voltage generator 109. The electron emitter 111 can be maintained at a very low voltage, such as for example −40 kV, and the anode can be maintained at ground 107 voltage. Due to the large voltage differential between the electron emitter 111 and the anode 103, and a high electron emitter 111 temperature, electrons can leave the electron emitter and be propelled towards the anode 103. X-rays 108 can be generated at the anode 103 in response to impinging electrons.

An x-ray source shell or casing (not shown) can also be maintained at ground 107 voltage. An electrically insulative potting material 106 can be used to isolate the large negative voltage of the cathode 102 and the evacuated enclosure 101 from the shell or casing.

Illustrated in FIG. 9 is a lateral cross-sectional side view of an x-ray tube 900 that is orthogonal to the longitudinal cross-sectional side view of the x-ray source of FIG. 8, taken along line 9-9 in FIG. 8. Illustrated in FIG. 10 is a chart 1000 showing a change in voltage from a voltage of the cathode $V_c$ to a voltage of zero at an outer perimeter of the potting 201. Note that there is a sudden and large change in voltage at a transition 1002 from the cathode 102 to the potting 106. This sudden and large change in voltage also occurs at a transition from the evacuated enclosure 101 to the potting 106, especially in portions of the evacuated enclosure 101 closer or adjacent to the cathode 102.

This sudden and large change in voltage, or large voltage gradient at and near this transition point 1002 can result in problems such as a breakdown of the potting material 106 at this point and also a buildup of surface charges on a surface of the evacuated enclosure 101. The breakdown of the potting material 106 can result in a short circuit of the x-ray source from the evacuated enclosure 101 or cathode 102 to other components or the shell or casing. A buildup of surface charges can cause x-ray source instability. Thus it can be desirable to reduce this voltage gradient.

SUMMARY

It has been recognized that it would be advantageous in an x-ray source to reduce the voltage gradient from the evacuated enclosure or cathode to other components or the shell or casing in the x-ray source. The present invention is directed to an x-ray source that satisfies these needs and comprises an evacuated enclosure with a cathode and an anode attached to the evacuated enclosure. The cathode can be configured to emit electrons within the enclosure. The anode can be configured to receive electrons emitted from the cathode and configured to emit x-rays in response to impinging electrons. A semiconductor coating can be disposed over an exterior of the evacuated enclosure and an electrically insulative potting material disposed over an outer surface of the semiconductor coating. Use of the semiconductor coating can reduce the voltage gradient.

DEFINITIONS

Figure 1:
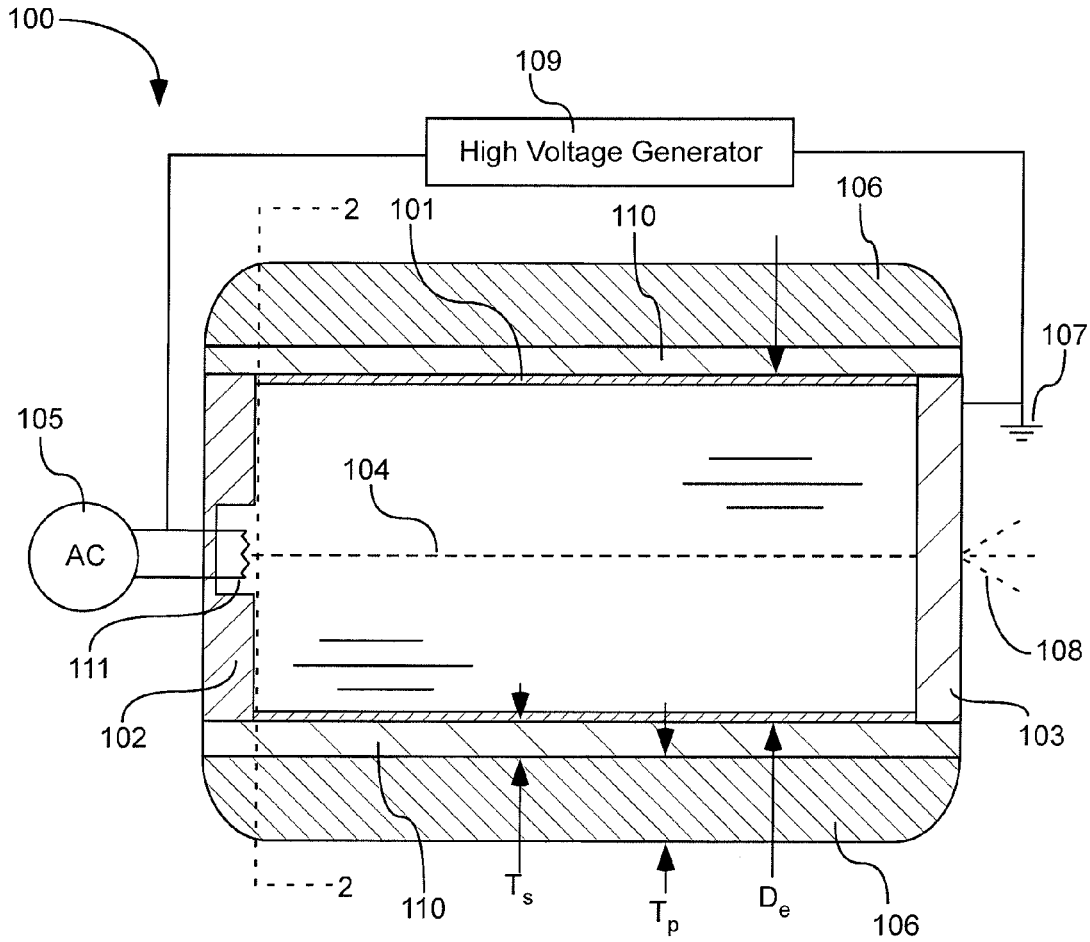
FIG. 1 is a schematic longitudinal cross-sectional side view of an x-ray tube in accordance with an embodiment of the present invention.

As used herein, the terms "approximately" or "about" are used to provide flexibility to a numerical range endpoint by providing that a given value may be "a little above" or "a little below" the endpoint or numerical value.

As used herein, the term "evacuated enclosure" means a sealed enclosure that has an internal pressure substantially less than atmospheric pressure. The actual internal pressure will depend on the application. For example, the internal pressure may be less than $10^{-6}$ atm, less than $10^{-7}$ atm, or less than $10^{-8}$ atm.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, an x-ray source 100 is shown comprising an evacuated enclosure 101 with a cathode 102 and an anode 103 attached to the evacuated enclosure 101. The cathode 102 can be configured to emit electrons 104 within the enclosure 101. For example, the cathode 102 can have an electron emitter 111, such as a filament. The electron emitter 102 can be heated, such as by electric current from an alternating current source 105. A high voltage generator 109 can provide a large negative voltage at the cathode 102 and electron emitter 111 relative to the anode 103, which can be at ground voltage 107. Due to a high temperature of the electron emitter 111 and the large voltage differential between the electron emitter 111 and the anode 103, electrons can be emitted from the electron emitter 111 and propelled towards the anode 103.

The anode 103 can be situated to receive electrons 104 emitted from the cathode 102 and can be configured to emit x-rays 108 in response to impinging electrons 104. For example, the anode can be coated with a target material such as gold, rhodium, or silver. Electrons can impinge upon the target material and produce x-rays. The anode can include a window that is made of a material and thickness that will allow x-rays 108 generated in the target to exit the x-ray source 100.

An x-ray source can include a shell or casing and other components that may be at ground voltage or voltages that are very different from a voltage of the cathode 102 and portions of the enclosure 101. The voltage differential between such casing or components and the cathode 102 and enclosure 101 can be very large, such as around 10-80 kilovolts. Electrically insulative potting 106 can be disposed over or around the enclosure 101 and/or cathode 102 to electrically isolate the enclosure 101 and/or cathode 102 from surrounding components and casing.

In order to avoid a very large and sudden voltage change at a junction of the enclosure 101 and/or cathode 102 and potting 106, a semiconductor coating 110 can be disposed between the enclosure 101 and/or cathode 102 and the potting 106.

A thickness $T_s$ of semiconductor coating 110 and a thickness $T_p$ of potting 106 can be selected based on materials chosen, the magnitude of the voltage differential, size of the x-ray tube, and cost considerations. In one embodiment, a thickness $T_s$ of the semiconductor coating 110 is between 10% and 75% of an outer diameter $D_e$ of the evacuated enclosure 101. In another embodiment, a thickness $T_s$ of the semiconductor coating 110 is between 10% and 60% of an outer diameter $D_e$ of the evacuated enclosure 101 and a thickness $T_p$ of the potting 106 is between 20% and 70% of the outer diameter $D_e$ of the evacuated enclosure 101. In another embodiment, a thickness $T_s$ of the semiconductor coating 110 is between 10% and 100% of a thickness $T_p$ of the potting 106.

Figure 2:
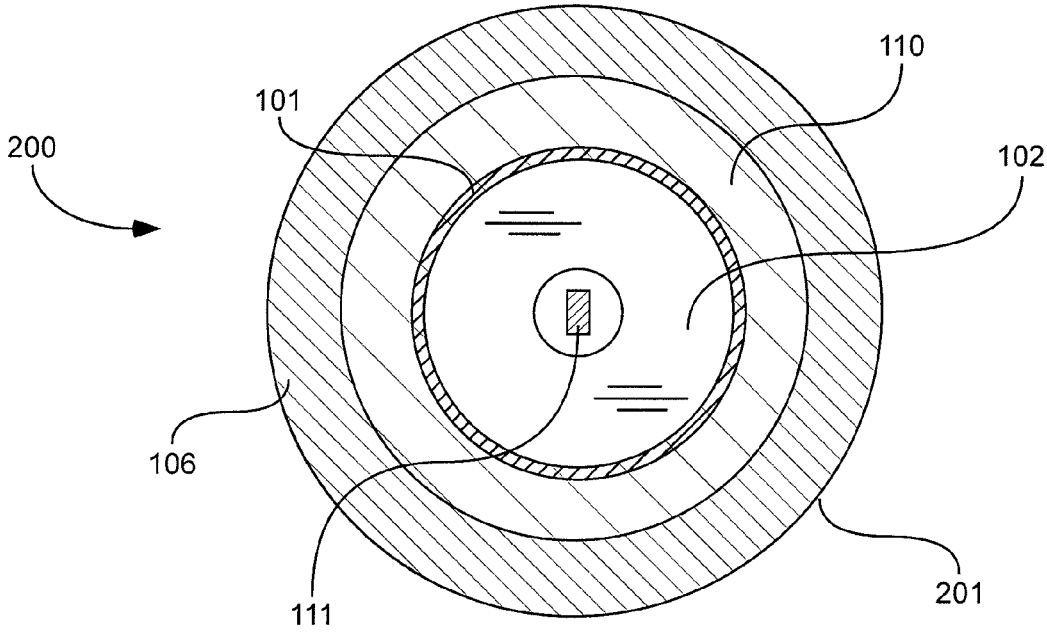
FIG. 2 is a schematic lateral cross-sectional side view that is orthogonal to the longitudinal cross-sectional side view of the x-ray tube of FIG. 1 taken along line 2-2 in FIG. 1, in accordance with an embodiment of the present invention.
Figure 3:
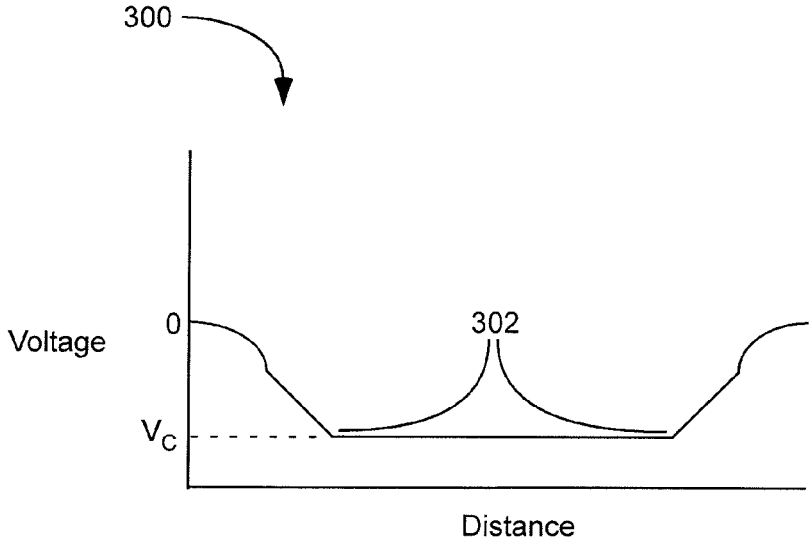
FIG. 3 is chart showing a voltage gradient from a cathode or evacuated enclosure, through semiconductor coating and potting, to an outside surface of the potting of the x-ray tube of FIG. 2, in accordance with an embodiment of the present invention.
Figure 10:
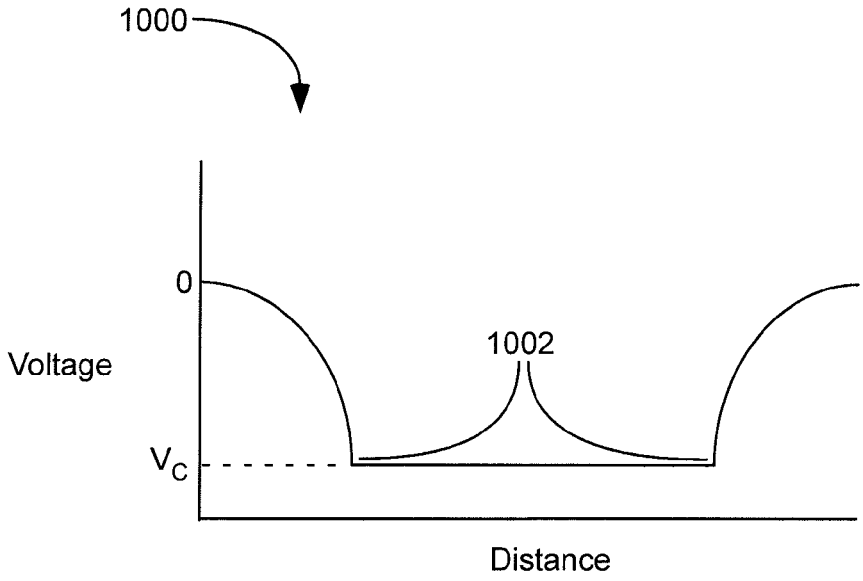
Fig. 10 prior art
FIG. 10 is chart showing a voltage gradient from a cathode or evacuated enclosure, through insulative potting, to an outside surface of the potting of the x-ray tube of FIG. 9, in accordance with the prior art.

Illustrated in FIG. 2 is a lateral cross-sectional side view of an x-ray tube 200 that is orthogonal to the longitudinal cross-sectional side view of the x-ray source of FIG. 1, taken along line 2-2 in FIG. 1. Illustrated in FIG. 3 is a chart 300 showing a change in voltage from a voltage of the cathode $V_c$ to a voltage of zero at an outer perimeter of the potting 201. Note that the change in voltage per unit distance at the transition 302 from the cathode 102 to the semiconductor material 110 is smaller than the transition 1002 from cathode 102 to potting 106 shown in FIG. 10, in a configuration without the semiconductor material.

The change in voltage per unit distance from the cathode 102 or evacuated enclosure 101 to the outer perimeter 201 of the potting 106 is called a voltage gradient $$\left(\frac{dV}{dr}\right).$$

in one embodiment or the present invention, a maximum voltage gradient is less than 0.1 times a voltage V of the cathode 102 divided by a radius of the evacuated enclosure $$\frac{dV}{dr} < \frac{0.1 * V}{r}.$$

In another embodiment of the present invention, a maximum voltage gradient is less than the voltage V of the cathode 102 divided by a radius of the evacuated enclosure $$\frac{dV}{dr} < \frac{V}{r}.$$

In another embodiment of the present invention, a maximum voltage gradient is less than 10 times the voltage V of the cathode 102 divided by a radius of the evacuated enclosure $$\frac{dV}{dr} < \frac{10 * V}{r}.$$

In another embodiment of the present invention, a maximum voltage gradient is less than 20 times the voltage V of the cathode 102 divided by a radius of the evacuated enclosure $$\frac{dV}{dr} < \frac{20*V}{r}.$$

In another embodiment of the present invention, a maximum voltage gradient is less than 50 times the voltage V of the cathode 102 divided by a radius of the evacuated enclosure $$\frac{dV}{dr} < \frac{50*V}{r}.$$

A smaller voltage gradient can result in reduced breakdown of the potting material and reduced buildup of surface charges on the enclosure 101.

Figure 4:
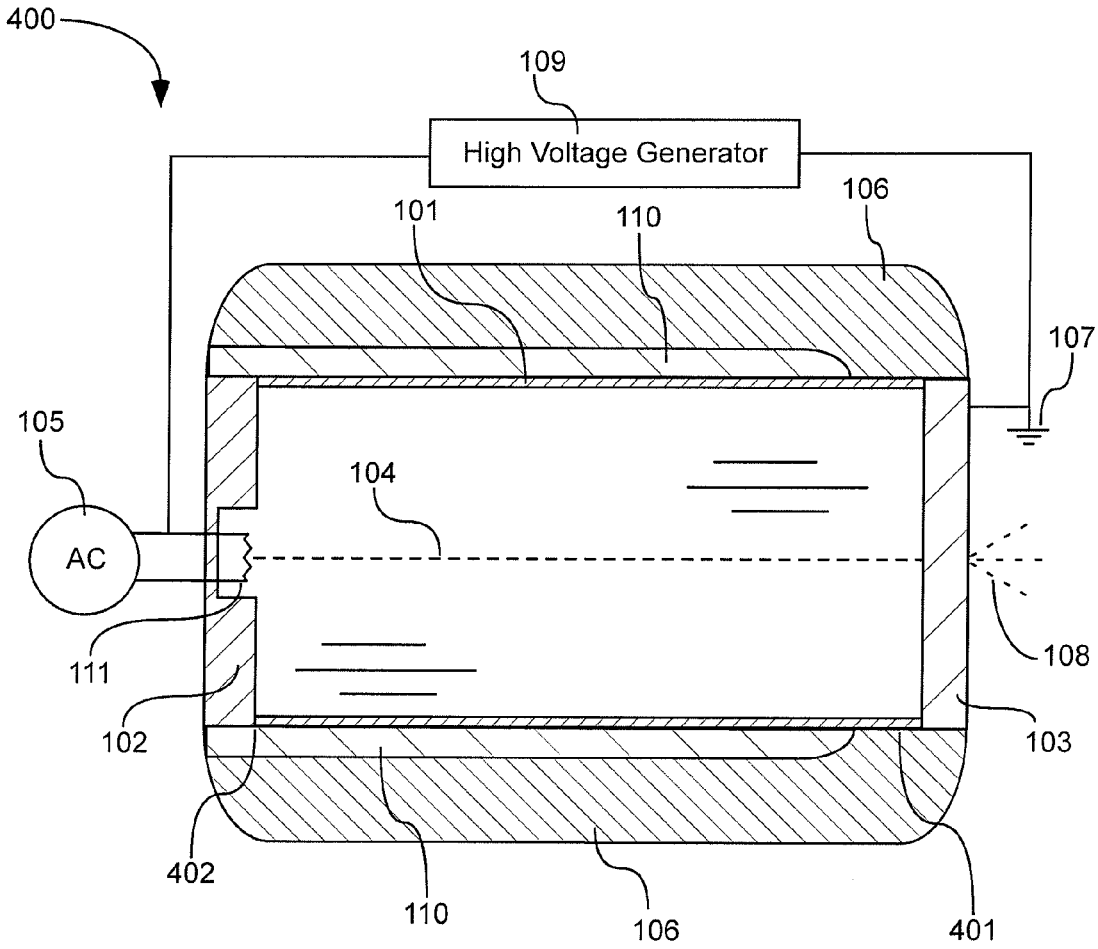
FIG. 4 is a schematic longitudinal cross-sectional side view of an x-ray tube in which semiconductor coating does not cover the entire outer surface of the enclosure, in accordance with an embodiment of the present invention.

As shown in FIG. 1, the semiconductor coating 110 can cover an entire outer or exterior surface of the enclosure 101. The semiconductor coating 110 can also cover the entire junction of the cathode 102 to the evacuated enclosure 101. As shown in FIG. 4, the semiconductor coating 110 can cover part of the outer surface of the enclosure 101, leaving part of the evacuated enclosure covered directly by potting 106, such as at location 401. This configuration may be chosen based on cost and manufacturability reasons. It can be more important to cover the enclosure 101 and cathode 102 to enclosure 101 junction 402 than the enclosure near the anode 103 because the anode can be at ground 107 voltage and thus voltage gradient problems might not exist at or near the anode 103. In one embodiment, the semiconductor coating 110 covers at least 75% of the exterior of the evacuated enclosure.

Figure 5:
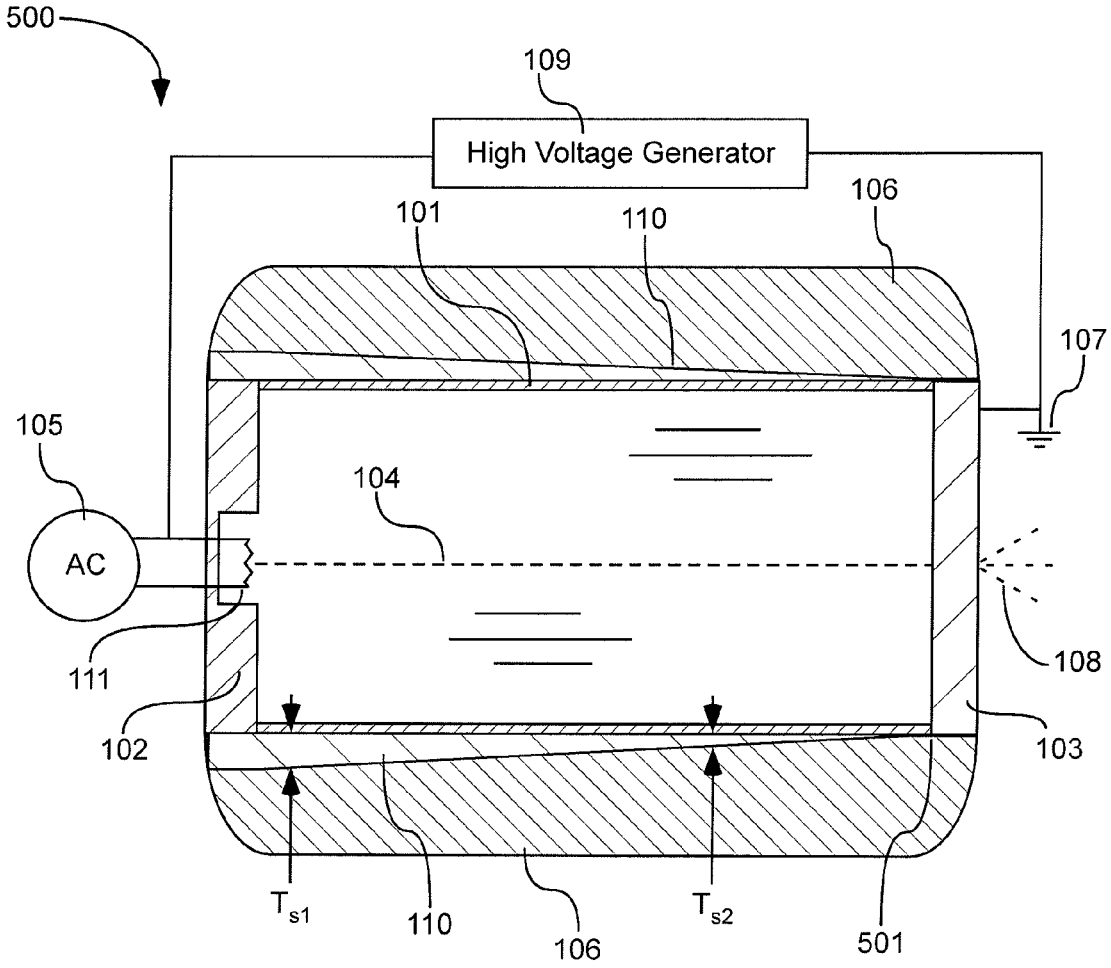
FIG. 5 is a schematic longitudinal cross-sectional side view of an x-ray tube with a variable thickness semiconductor coating in which the semiconductor coating is thicker near the cathode than near the anode, in accordance with an embodiment of the present invention.

As shown in FIG. 1, the semiconductor coating 110 can have a substantially uniform thickness $T_s$ across a surface of the evacuated enclosure 101. As shown in FIG. 5, x-ray source 500 can include a semiconductor coating 110 with a variable thickness. In FIG. 5, a thickness $T_{s1}$ of semiconductor coating 110 can be thicker on the enclosure 101 near the cathode 102 than a thickness $T_{s2}$ of semiconductor coating 110 near the anode. In one embodiment, a thickness of semiconductor coating 110 at the cathode can be at least twice as thick as semiconductor coating at the anode 103. It can be more important to have thicker semiconductor coating 110 near the cathode 102 because higher voltage differentials with surrounding components can exist at and near the cathode 102 than at or near the anode 103. In one embodiment, the semiconductor coating 110 thickness $T_s$ is approximately proportional to a voltage gradient between the evacuated enclosure and the ground 107, thus the semiconductor coating 110 has a larger thickness $T_s$ near the cathode 102 than near the anode 103. In one embodiment, the semiconductor coating 110 thickness $T_s$ is approximately proportional to a voltage gradient between the evacuated enclosure 101 and the ground 107, thus the semiconductor coating 110 has a larger thickness $T_s$ near the cathode 102 than near the anode 103.

Figure 6:
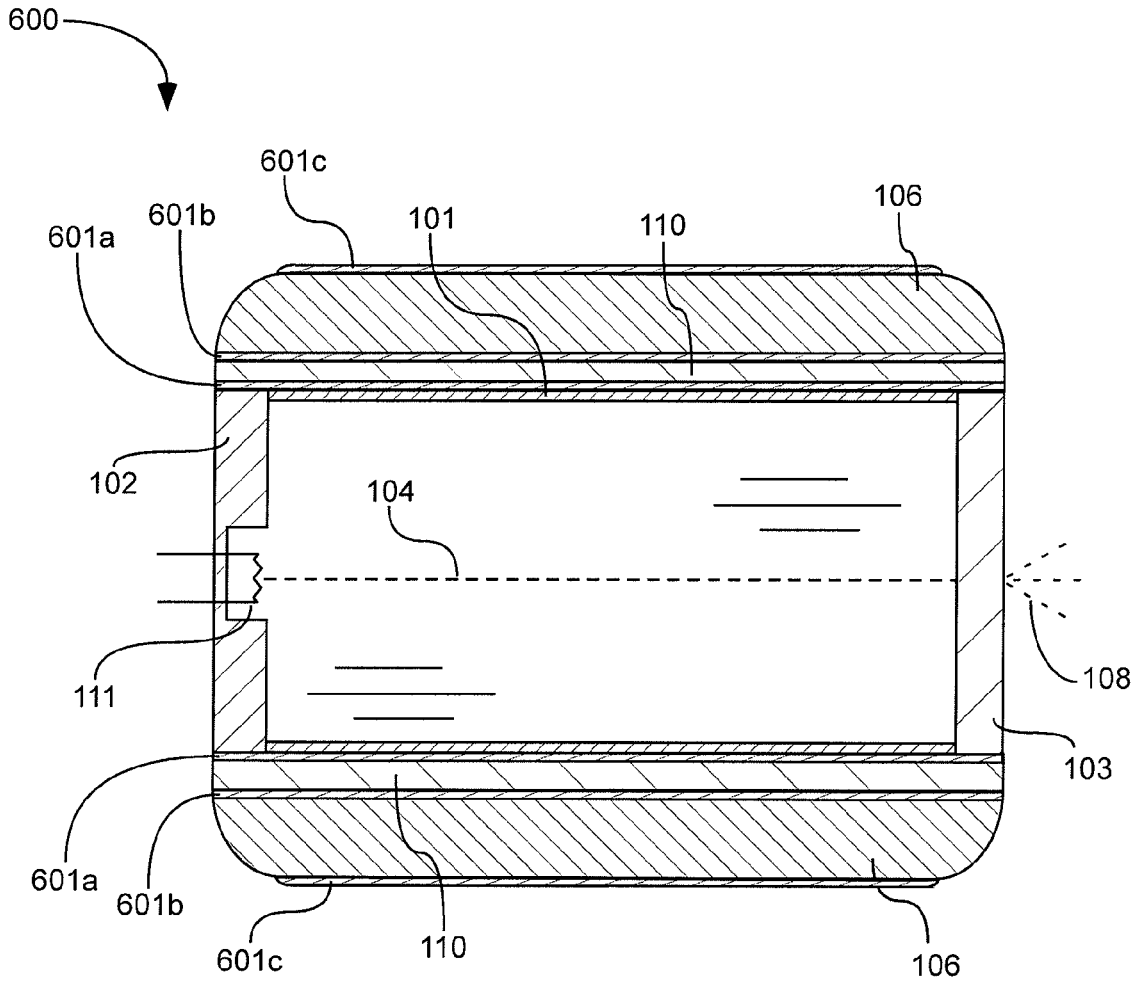
FIG. 6 is a schematic longitudinal cross-sectional side view of an x-ray tube in accordance with an embodiment of the present invention.

As shown in FIG. 1, the semiconductor coating 110 can be disposed directly on top of and attached directly to the evacuated enclosure 101. Alternatively, as shown in x-ray tube 600 in FIG. 6, a non-semiconductor material 601*a* can be disposed between the enclosure 101 and the semiconductor 110. The non-semiconductor material 601*a* can extend across the entire exterior surface of the enclosure 101 or only part of this surface. This non-semiconductor material 601*a* can be a layer of graphene. Graphene can be useful for assisting with magnet focusing of the electron beam 104.

As shown in FIG. 1, the potting material 106 can be disposed directly on top of and attached directly to the semiconductor material 110. Alternatively, as shown in x-ray tube 600 in FIG. 6, a non-semiconductor material 601*b* can be disposed between the potting 106 and the semiconductor 110. The non-semiconductor material 601*b* can extend across the entire exterior surface of the semiconductor 110 or only part of this surface. This non-semiconductor material 601*b* can be a layer of graphene. Graphene can be useful for assisting with magnet focusing of the electron beam 102. Graphene 601*c* can also be disposed on an outer surface of the potting 106.

The semiconductor coating 110 can comprise silicon. The semiconductor coating 110 and the potting material 106 can be different materials. The potting material 106 can be any suitable electrically insulative material, such as a material comprising silicon, a polymer, rubber, or combinations thereof. The semiconductor material 110 and the potting material 106 can be applied by sputter or dip.

Graphene

Figure 7:
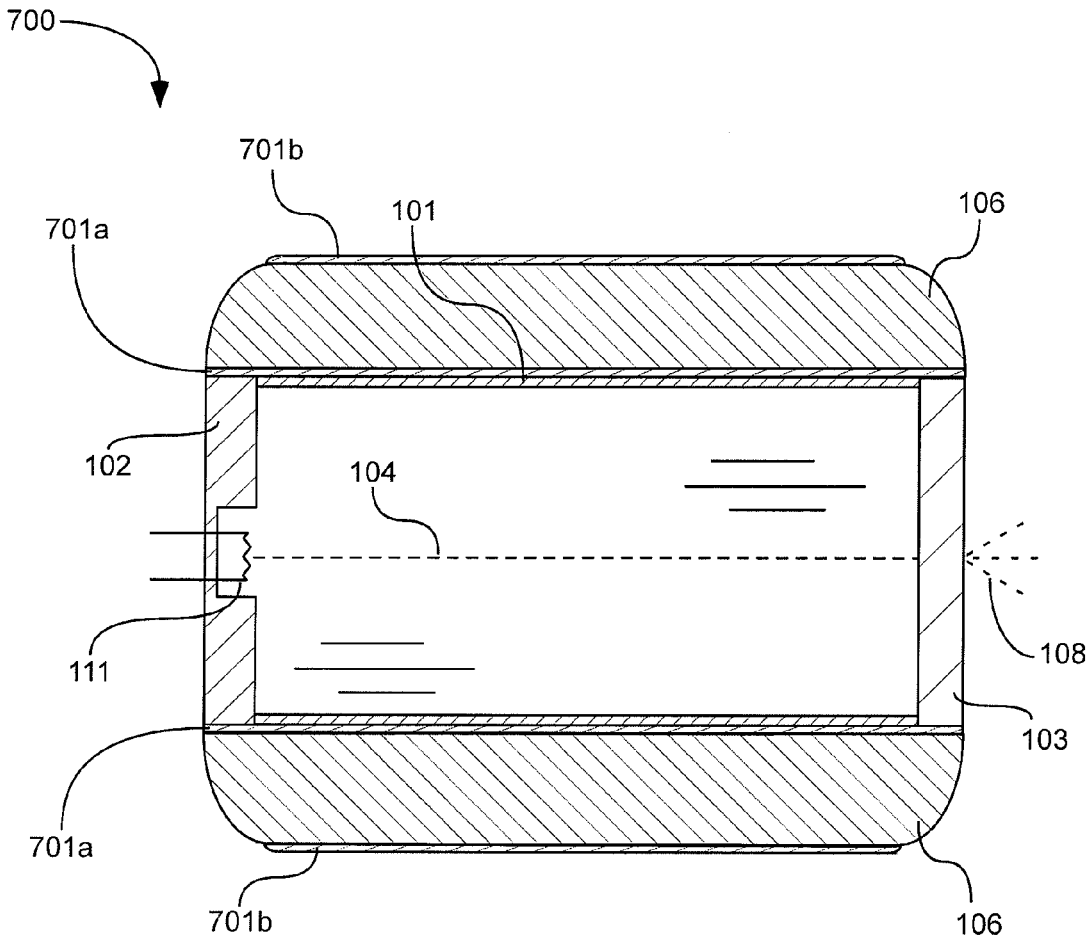
FIG. 7 is a schematic longitudinal cross-sectional side view of an x-ray tube in accordance with an embodiment of the present invention.
Figure 8:
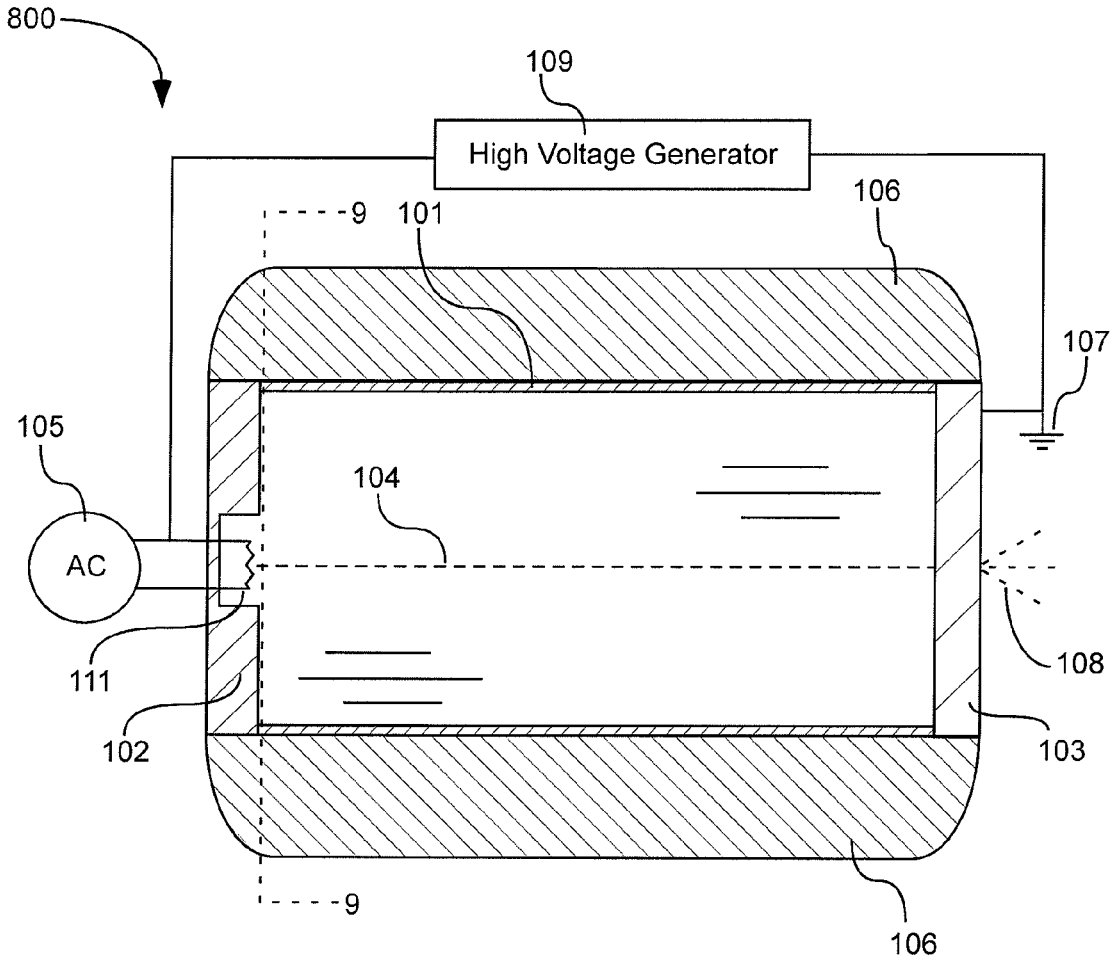
Fig. 8 prior art
FIG. 8 is a schematic longitudinal cross-sectional side view of an x-ray tube in accordance with the prior art.
Figure 9:
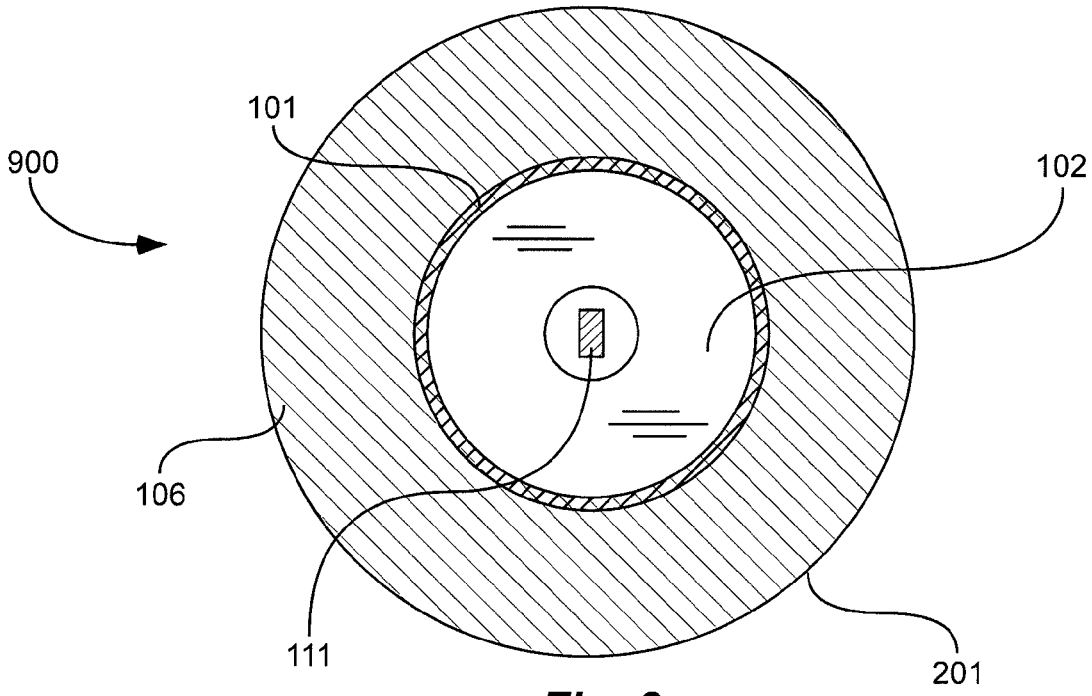
Fig. 9 prior art
FIG. 9 is a schematic lateral cross-sectional side view that is orthogonal to the longitudinal cross-sectional side view of the x-ray tube of FIG. 8 taken along line 9-9 in FIG. 7, in accordance with the prior art.

As illustrated in FIG. 7, an x-ray source 700 is shown comprising an evacuated enclosure 101 with a cathode 102 and an anode 103 attached to the evacuated enclosure 101. The cathode 102 can be configured to emit electrons 104 within the enclosure 101. For example, the cathode 102 can have an electron emitter 111, such as a filament. The electron emitter 102 can be heated, such as by electric current. A high voltage generator can provide a large negative voltage at the cathode 102 and electron emitter 111 relative to the anode 103, which can be at ground voltage 107. Due to a high temperature of the electron emitter 111 and the large voltage differential between the electron emitter 111 and the anode 103, electrons, as an electron beam 104, can be emitted from the electron emitter 111 and propelled towards the anode 103.

The anode 103 can be situated to receive electrons 104 emitted from the cathode 102 can be configured to emit x-rays 108 in response to impinging electrons 104. For example, the anode 103 can be coated with a target material such as gold, rhodium, or silver. Electrons 1040 can impinge upon the target material and produce x-rays. The anode 103 can include a window that is made of a material and thickness that will allow x-rays 108 generated in the target to exit the x-ray source 700.

It can be beneficial to focus the electron beam 104 to a small, consistent spot on the anode 103. A magnet, such as is described in U.S. Pat. No. 7,428,298, which is incorporated herein by reference, can be used to focus the electron beam 104. A layer of graphene 701 can be used to aid in magnet focusing of the electron beam 104. In one embodiment, a layer of graphene 701*a* can be disposed between potting material 106 and the enclosure 101. In another embodiment, a layer of graphene 701*b* can be disposed at an outer surface of the potting material 106. In another embodiment, at least one layer of graphene 701*a* can be disposed both between potting material 106 and the enclosure 101 and at least one layer of graphene 701*b* can be disposed at an outer surface of the potting material 106.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An x-ray tube comprising:

a) an evacuated enclosure;

b) a cathode attached to the evacuated enclosure and configured to emit electrons within the enclosure;

c) an anode attached to the evacuated enclosure, configured to receive electrons emitted from the cathode, and configured to emit x-rays in response to impinging electrons;

d) a semiconductor coating disposed over an exterior of the evacuated enclosure; and e) an electrically insulative potting material disposed over an outer surface of the semiconductor coating.

2. The x-ray tube of claim 1, wherein the semiconductor coating comprises silicon.

3. The x-ray tube of claim 1, wherein a thickness of the semiconductor coating is between 10% and 75% of an outer diameter of the evacuated enclosure.

4. The x-ray tube of claim 1, wherein a thickness of the semiconductor coating is between 10% and 60% of an outer diameter of the evacuated enclosure and a thickness of the potting is between 20% and 70% of the outer diameter of the evacuated enclosure.

5. The x-ray tube of claim 1, wherein a thickness of the semiconductor coating is between 10% and 100% of a thickness of the potting.

6. The x-ray tube of claim 1, wherein a maximum change in voltage per unit distance $$\left(\frac{dV}{dr}\right)$$

from the cathode or evacuated enclosure to an outer surface of the potting material is less than 0.1 times a voltage V of the cathode divided by a radius of the evacuated enclosure $$\frac{dV}{dr} < \frac{0.1 * V}{r}.$$

7. The x-ray tube of claim 1, wherein a maximum change in voltage per unit distance $$\left(\frac{dV}{dr}\right)$$

from the cathode or evacuated enclosure to an outer surface of the potting material is less than the voltage V of the cathode divided by a radius of the evacuated enclosure $$\frac{dV}{dr} < \frac{V}{r}.$$

8. The x-ray tube of claim 1, wherein a maximum change in voltage per unit distance $$\left(\frac{dV}{dr}\right)$$

from me cathode or evacuated enclosure to an outer surface of the potting material is less than 10 times the voltage V of the cathode divided by a radius of the evacuated enclosure $$\frac{dV}{dr} < \frac{10 * V}{r}.$$

9. The x-ray tube of claim 1, wherein a maximum change in voltage per unit distance $$\left(\frac{dV}{dr}\right)$$

from the cathode or evacuated enclosure to an outer surface of the potting material is less than 20 times the voltage V of the cathode divided by a radius of the evacuated enclosure $$\frac{dV}{dr} < \frac{20 * V}{r}.$$

10. The x-ray tube of claim 1, wherein a maximum change in voltage per unit distance $$\left(\frac{dV}{dr}\right)$$

from the cathode or evacuated enclosure to an outer surface of the potting material is less than 50 times the voltage V of the cathode divided by a radius of the evacuated enclosure $$\frac{dV}{dr} < \frac{50 * V}{r}.$$

11. The x-ray tube of claim 1, wherein the semiconductor coating covers substantially all of the exterior of the evacuated enclosure and a junction between the evacuated enclosure and the cathode.

12. The x-ray tube of claim 1, wherein the semiconductor coating covers at least 75% of the exterior of the evacuated enclosure and substantially all of a junction between the evacuated enclosure and the cathode.

13. The x-ray tube of claim 1, wherein the semiconductor coating is disposed directly on top of and attached directly to the evacuated enclosure and the potting material is disposed directly on top of and attached directly to the semiconductor material.

14. The x-ray tube of claim 1, wherein the semiconductor coating has a substantially uniform thickness across a surface of the evacuated enclosure.

15. The x-ray tube of claim 1, wherein:

a) a semiconductor coating thickness is approximately proportional to a voltage gradient between the evacuated enclosure and the ground; and b) the semiconductor coating is thicker near the cathode than near the anode.

16. The x-ray tube of claim 1, wherein the semiconductor coating and the potting are different materials.

17. The x-ray tube of claim 1, further comprising at least one layer of graphene disposed over an exterior of the evacuated enclosure.

18. An x-ray tube comprising:

a) an evacuated enclosure;

b) a cathode attached to the evacuated enclosure and configured to emit electrons within the enclosure;

c) an anode attached to the evacuated enclosure, configured to receive electrons emitted from the cathode, and configured to emit x-rays in response to impinging electrons; and d) at least one layer of graphene disposed over an exterior of the evacuated enclosure.

19. The x-ray tube of claim 18, further comprising an electrically insulative potting material disposed over at least one layer of graphene.

20. An x-ray tube comprising:

a) an evacuated enclosure having an internal pressure of less than $10^{-7}$ atm;

b) a cathode attached to the evacuated enclosure and configured to emit electrons within the enclosure;

c) an anode attached to the evacuated enclosure, configured to receive electrons emitted from the cathode, and configured to emit x-rays in response to impinging electrons;

d) a semiconductor coating comprising silicon disposed over and attached directly to the evacuated enclosure;

e) the semiconductor coating covering at least 50% of an exterior of the evacuated enclosure;

f) the semiconductor coating covering a junction of the cathode and the evacuated enclosure; and g) an electrically insulative potting material disposed over at least 80% of an outer surface of the semiconductor coating.

* * * * *